US005775412A

United States Patent [19]

Montestruc, III et al.

[11] Patent Number: 5,775,412

[45] Date of Patent: Jul. 7, 1998

[54] HIGH PRESSURE DENSE HEAT TRANSFER AREA HEAT EXCHANGER

[75] Inventors: Alfred N. Montestruc, III, Slidell, La.; G. Frederick Liebkemann, IV, Pearlington, Miss.

[73] Assignee: Gidding Engineering, Inc., Slidell, La.

[21] Appl. No.: 583,824

[22] Filed: Jan. 11, 1996

[51] Int. Cl.[6] ..... F28F 9/00

[52] U.S. Cl. ..... 165/134.1; 165/157; 165/166; 165/DIG. 384

[58] Field of Search ..... 165/134.1, 165, 165/166, DIG. 356, DIG. 373, DIG. 384, 157

[56] References Cited

U.S. PATENT DOCUMENTS

| | | | |
|---|---|---|---|
| 2,151,540 | 3/1939 | Varga . | |
| 2,329,953 | 9/1943 | Staky | 165/160 |
| 2,703,700 | 3/1955 | Simpelaar | 165/165 X |
| 2,877,000 | 3/1959 | Person . | |
| 2,941,787 | 6/1960 | Ramen . | |
| 2,957,679 | 10/1960 | Campbell . | |
| 3,095,839 | 7/1963 | Vollhardt et al. . | |
| 3,106,192 | 10/1963 | Hingst . | |
| 3,111,581 | 11/1963 | Vollhardt . | |
| 3,164,204 | 1/1965 | Hingst . | |
| 3,229,762 | 1/1966 | Vollhardt . | |
| 3,306,351 | 2/1967 | Vollhardt . | |
| 3,348,610 | 10/1967 | Vollhardt . | |
| 3,481,321 | 12/1969 | Reichelderfer . | |
| 3,537,165 | 11/1970 | Paddock et al. . | |
| 3,605,882 | 9/1971 | Smith et al. . | |
| 3,682,241 | 8/1972 | Clauss et al. . | |
| 3,850,234 | 11/1974 | Fowler . | |
| 3,995,689 | 12/1976 | Cates . | |
| 4,130,398 | 12/1978 | Knulle et al. . | |
| 4,168,744 | 9/1979 | Knule et al. . | |
| 4,206,748 | 6/1980 | Goodman et al. . | |
| 4,337,826 | 7/1982 | Kritzer . | |
| 4,440,337 | 4/1984 | Eckert . | |
| 4,497,363 | 2/1985 | Heronemus | 165/95 |
| 4,867,234 | 9/1989 | Herrmann . | |
| 4,893,588 | 1/1990 | Jekerle et al. . | |
| 4,932,469 | 6/1990 | Beatenbough . | |
| 4,945,978 | 8/1990 | Herrmann . | |
| 4,993,479 | 2/1991 | Jekerle . | |
| 5,007,970 | 4/1991 | Herrmann et al. . | |
| 5,088,551 | 2/1992 | Brucher et al. . | |
| 5,129,144 | 7/1992 | Halstead et al. . | |
| 5,154,571 | 10/1992 | Prumper . | |
| 5,178,102 | 1/1993 | Kehrer et al. . | |
| 5,217,006 | 6/1993 | Killebrew . | |
| 5,246,063 | 9/1993 | Fix et al. . | |
| 5,261,355 | 11/1993 | Scalfi | 165/165 X |
| 5,271,151 | 12/1993 | Wallis . | |
| 5,277,241 | 1/1994 | Schneider . | |

FOREIGN PATENT DOCUMENTS

| | | | |
|---|---|---|---|
| 507726 | 11/1954 | Canada | 165/165 |
| 875306 | 9/1942 | France | 165/165 |
| 1329719 | 5/1963 | France | 165/165 |
| 807939 | 7/1951 | Germany | 165/165 |
| 450746 | 8/1949 | Italy | 165/165 |

*Primary Examiner*—Allen J. Flanigan
*Attorney, Agent, or Firm*—Pravel, Hewitt, Kimball & Krieger

[57] ABSTRACT

A heat exchanger apparatus (which can be a boiler) includes a plurality of tanks assembled together. Each of the tanks is a separate structural member that provides opposed parallel surfaces. The surfaces carry a plurality of parallel longitudinally extending U-shaped grooves that are correspondingly placed. When the grooves are aligned, they form a first plurality of channels for holding a first fluid system. A load-carrying portion of each plate-like tank extends between the opposed surfaces. A second plurality of fluid conveying channels carries a second fluid system through the load carrying portion of the tank. Fluid inlets and outlets are provided for each fluid system. The design of the present invention provides an improved plate-like tank structure that allows the separate fluid systems to be maintained at substantial pressure differentials such as, for example, between about 1,000–3,200 p.s.i.

22 Claims, 6 Drawing Sheets

HIGH PRESSURE DENSE HEAT TRANSFER AREA HEAT EXCHANGER

BACKGROUND OF THE INVENTION

1. Field of the Invention

The present invention relates to heat exchangers and boilers and more particularly relates to an improved heat exchanger/boiler that utilizes a series of tanks each of which is of a specific cross-sectional shape with arch-like portions along one side that will strongly resist buckling from pressure on one side. Even more particularly, the present invention relates to an improved heat exchanger/boiler apparatus wherein the plate-like tanks can be manufactured, for example, of a hot-rolled metallic construction (or by casting, forging, machining, or a modified partial casting process that uses electro-gas welding to produce the shaped plates) allowing the variable thickness plates to be stacked such that the tendency of each tank to bulge out in the middle is restrained by the same tendency of adjacent tanks.

2. General Background

A heat exchanger is a device that transfers heat from one fluid to another. One type of heat exchanger is a boiler, which is simply a water heater for generating steam. As used herein, the term "heat exchanger" refers to a heat exchanger or boiler.

Heat exchangers are used in many applications in the petrochemical industry, power plant industry, and in the ship building industry. As an example, heat exchangers can be used to create steam power. As another example, heat exchangers can be used as an efficient means of quenching chemical reactions in process gas streams in the chemical industry.

Many patents have issued that relate generally to heat exchangers and boilers. Two examples of patents that relate to heat exchangers/boilers are the Paddock U.S. Pat. No. 3,537,165 and the Goodman U.S. Pat. No. 4,206,748. The present invention affords substantial and considerable design advantages over the Paddock patent. First, the cross-sectional shape of the tank wall of the present invention as shown in the drawings varies in width in a manner that makes two tank walls which are much more resistant to uniform and identical pressure loads from the inside of the tanks when placed together. This arrangement also produces round low pressure fluid flow passages from one side of the tank bundled to the other for the low pressure fluid. The design of the present invention can practically and with low cost resist pressure differential between the high and low pressure fluids of more than 3200 p.s.i. The plates for the present invention are made using a rolling process, casting, forging, machining, or a modified partial casting process which involves electro-gas welding to produce specially shaped plates. The Paddock patent provides a design that cannot practically resist such high pressure differential as it is made of flat plates which are stamped are otherwise bent into shape. These flat plates which produce the shapes such as is shown in Paddock FIGS. 2 and 3 cannot resist the pressure loads of more than 3200 p.s.i. which can be resisted with the design of the present invention. In order to resist such pressure levels, the Paddock design would necessarily require impractical thicknesses of metal which would raise fabrication costs to very high and unacceptable levels.

The present invention provides another major advantage over the Paddock type design. The present invention provides a strong back arrangement wherein D-shaped tanks and tension legs are used to carry bending and tension loads. A simple strong back arrangement such as is shown in Paddock will be in bending and deflect in a manner which will not uniformly support the tanks and would require very large thicknesses of metal to contain the pressure of, for example, 3200 p.s.i. The "D" tank arrangement of the present invention provides a tank of a special shape that is filled with a fluid held at the same pressure as the high pressure fluid in the heat exchanger. Usually it will be the same fluid. This means that the walls of the "D" tank will not be exposed to bending, but rather be in simple tension. The design of the present invention provides a "D" tank construction that contains the tank bundle at very high pressures and at much lower cost and weight than the arrangement such is depicted in Paddock.

The Goodman U.S. Pat. No. 4,206,748 discloses a design that is intended to be a solar collector and to be made primarily of plastic materials. In FIGS. 6, 7, and 8 of Goodman, there can be seen a beginning flat sheet of plastic which is hot molded into shapes shown in the other figures. FIGS. 7 and 8 of Goodman are cross-sectional views of FIG. 6 of Goodman. Those shapes made from plates do not vary in thickness at all, and are not designed to resist bending due to internal or external pressure. This becomes clear when FIG. 1 of the present invention is compared with FIG. 6–8 of Goodman. Thus, it is believed that the Goodman patent does not disclose a variable thickness plate to resist bending due to internal or external pressure and has no specific application to heat transfer to or from very high pressure fluids such as, for example, 3200 p.s.i.

SUMMARY OF THE INVENTION

The present invention provides an improvement to heat exchangers and boilers in that the apparatus of the present invention strongly resist buckling from pressure on one side of plates that are made into a specific shape with arch-like portions spaced along one side.

The present invention enables the construction of a modular heat exchanger which has the advantages of compactness typically associated with a flat plate heat exchanger yet the ability to contain enormous differential pressures between the fluids. The present invention accomplishes this utility without using exotic materials.

Waste heat recovery is frequently done with the intent of producing work. The apparatus of the present invention can be used as a waste heat recovery boiler that will be more efficient than existing designs. The present invention provides a heat exchanger apparatus that is cost efficient and which can produce steam at much higher pressure and thus thermodynamic potential. The present invention provides a very compact heat exchanger apparatus that will make steam power more competitive in any steam power generation application.

One of the features of the apparatus of the present invention is that it strongly resists buckling from pressure on one side. This is possible because of the use of a plurality of slim, thin walled, flat tanks. Each tank is constructed from specially formed plates employing specific arch-like reinforcement. More specifically, these specially formed plates utilize both shaped parallel channels and a specific arch-like cross-sectional shape with variable thickness of the plate to achieve high pressure carrying ability when the tanks are stacked together. The present invention thus provides an improved variable tank wall thickness combined with an arch-like shape that has allowed the heat exchange of the present invention to be used in very high pressure applications. Each tank forms a module of the heat exchanger.

Passages between the tanks for a low pressure fluid are formed by the structure of the grooves on the surfaces of the plates. A retaining structure is placed on either end of the stack of tanks with tension members connecting the two restraining structures. The design of the present invention can achieve fluid pressure differentials of as high as three thousand two hundred (3200) p.s.i. while at the same time having heat transfer area densities of, for example, 1.29 square inches per cubic inch inside the heat exchanger core. These assertions are based upon fabrication of the tanks of an ordinary strength carbon steel material. This compares to values as high 0.62 square inches per cubic inch in the core of a high pressure boiler found in some very expensive specialized modern high pressure fire-tube boilers.

The present invention has energy saving features. It will allow the recovery of waste heat of higher thermodynamic potential (high temperature). That will allow a greater fraction of the waste heat recovered to be converted to work. In addition, because it is compact it will be applicable in situations where no heat recovery as yet been attempted. The present invention will be able to recover heat at higher pressure differentials and will make waste heat recovery more economical.

Much waste heat is currently recovered. However, waste heat is typically recovered at steam pressures of between two hundred (200) and five hundred (500) p.s.i. With the present invention, heat can be recovered at higher steam pressures which translates into higher temperatures. This in turn translates to higher thermodynamic efficiencies.

The design of the heat exchanger of the present invention is less expensive to produce and customize than many existing heat exchangers intended for the same high (i.e., 1,000–3,000 p.s.i.) pressure differential. This is due to the fact that the design of the present invention is modular, simple to assemble, and provides a plurality of tanks, each of which can be made using automated techniques.

The present invention provides a practical and economically viable design of a heat exchanger apparatus. This will be especially true where very high differential pressures are desired. The modular nature of this design enables the construction of very large (in terms of heat capacity) boilers using the design of the present invention. This design will be affordable at relatively lost cost as the primary boiler for coal, oil, and gas-fired steam power plants in either new construction or renovation.

The present invention thus provides a heat exchanger apparatus that includes a plurality of tanks assembled together. Each of the tanks is comprised of a separate structural member.

A pair of opposed parallel surfaces are provided on each tank, the surfaces of adjacent tanks being in face-to-face contact upon assembly.

A plurality of parallel, longitudinally extending grooves are formed on the opposed surfaces of each tank, the grooves being correspondingly placed on each tank so that a closed fluid conveying channel is formed when two tanks are placed together and oriented so that the grooves of the tank are aligned.

A high pressure carrying portion extends between the opposed surfaces and to the periphery of each tank.

A second plurality of fluid conveying channels extends through the high pressure carrying portion of each tank. A fluid inlet is provided for adding a first fluid at a first pressure value to the first plurality of channels. A corresponding fluid outlet is provided for removing the first fluid from the first plurality of channels.

A fluid inlet for adding a second fluid to the second plurality of channels is provided and an outlet for removing that second fluid from the second plurality of channels.

The first and second fluid systems are maintained as separate fluid streams and at substantial pressure differential during use.

A retaining structure for holding the tanks together is provided. In one embodiment, this restraining structure is in the form of a "D" tank that holds an identical fluid at the same pressure as the high pressure fluid in the core of the heat exchanger. The "D" tank design eliminates much of the bending that would be associated with the use of strong backs in this situation. The force produced by the pressure inside the "D" tank is equal to the force produced by pressure in the stack of assembled core tanks. Two of these "D" tanks are connected together using tension straps with a "D" tank at each end of the stack of assembled core tanks. The "D" tanks and tension straps tend to surround the assembled tanks on the four sides that are not used for low pressure fluid ingress and egress.

The present invention provides an improved method for construction of a heat exchanger or boiler. The material from which the heat exchanger core is to be made is formed using any technique into tanks stock. This tank stock when welded or otherwise connected back-to-back with other tank stock provides a plurality of parallel U-shaped channels. The tank wall inner surface (the surface exposed to high pressure fluid) may be flat or may display waves with the same direction and frequency as the U-shaped channels on the outer (low pressure) surface.

The inlets and outlets of the adjoining modules are welded together on the inlet and outlet faces so as to allow a single manifold to be welded onto the structure thus formed.

With a stiff flat structure (strong back or "D" tank) placed to support either end of the core, the tendency of the modules to grow or bulge will be restrained. The edges of each tank form a half of a round tube in section, and may be treated as a tube for calculation of stress and strain. In this situation, the bursting force is proportional to the inside radius. So long as the inside radius is kept small, the bursting force in each tank in the directions perpendicular to the direction in which the tanks are stacked will also be small. The resistance to internal pressure loads will be significant. Another improvement of the present invention over existing designs is that by bending the tank stock to the inside radius along the edge which will become the hot fluid inlet, the welded connections which will be exposed to the high temperature inlet fluid will be reduced to zero. Cracking of welds in the high temperature inlet region is a major problem in some boiler designs. The present invention can be fabricated with no welds in the high temperature region.

The present invention provides an improvement over existing boiler and heat exchanger designs. Essentially, all modern boilers and high pressure heat exchangers use either a water tube design or a fire tube design. Either of those two designs maintains an approximately constant separation distance of the flue gas from the water, that being the thickness of the heat transfer tube wall. The design of the present invention does not require such an approximate constant separation distance. The wall thickness (steel thickness) between the water and gas surfaces varies considerably with the present invention.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
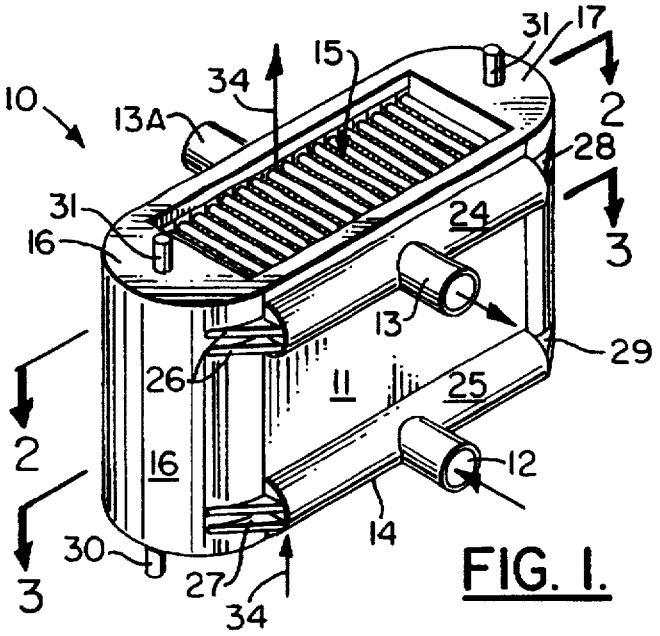
FIG. 1 is a perspective view of the preferred embodiment of the apparatus of the present invention.
Figure 2:
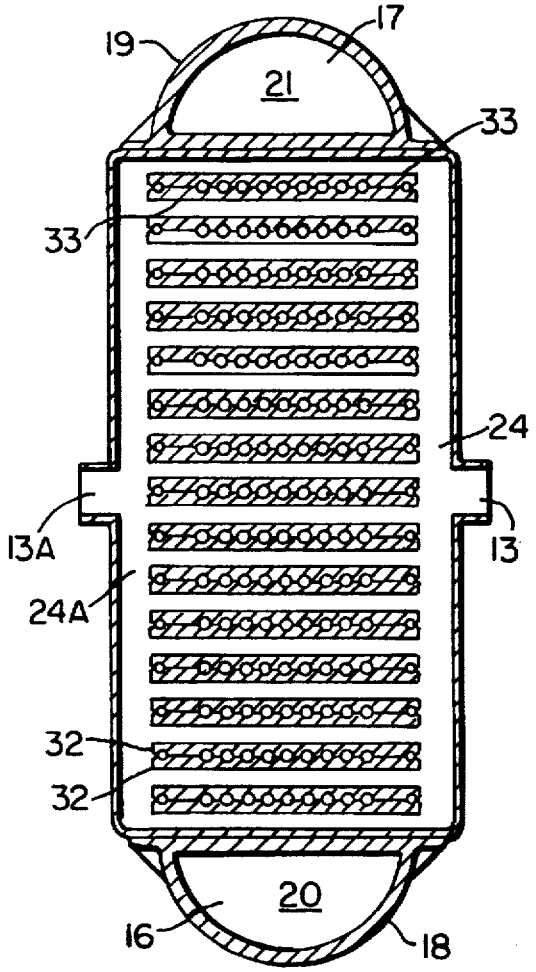
FIG. 2 is a horizontal sectional view taken along lines 2—2 of FIG. 1.

FIGS. 1–2 show generally the preferred embodiment of the apparatus of the present invention designated generally by the numeral 10. Heat exchanger 10 includes a vessel 11 having a high pressure inlet 12, a high pressure outlet 13, a lower pressure inlet 14 and a low pressure outlet 15.

A pair of "D" shaped tanks 16, 17 are positioned at opposing ends of vessel 11. Each "D" tank 16, 17 has a curved tank wall. The "D" tank 16 has curved tank wall 18, the "D" tank 17 has a curved wall 19. Each tank 16, 17 has a tank interior. The tank 16 has an interior 20. The tank 17 has an interior 21. The interiors 20, 21 contain fluid under high pressure as will be described more fully hereinafter. Further, the tanks 16, 17 function in combination with gusset plates 26, 27, 28, 29 to hold a plurality of inner tank elements and manifolds together.

Figure 3:
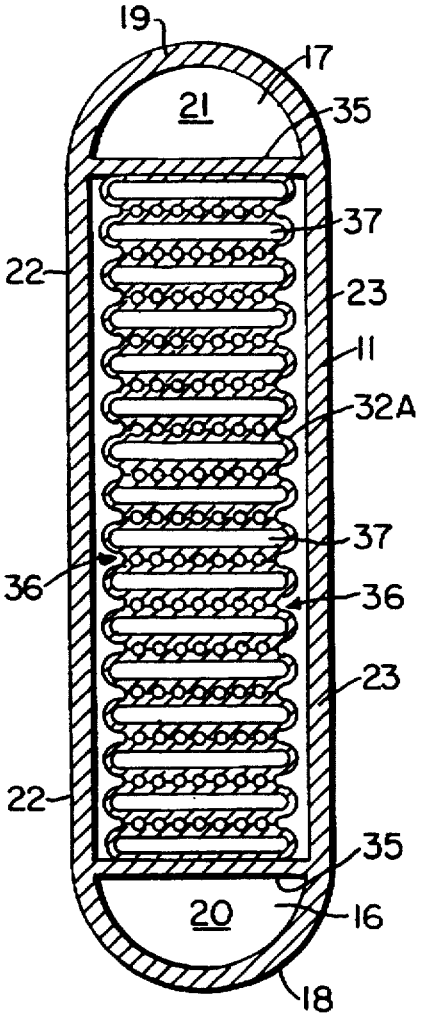
FIG. 3 is a horizontal sectional view taken along lines 3—3 of FIG. 1.

As shown in FIG. 3, the vessel 11 has a flat side wall on each side that communicates with the "D" tank 16, 17 curved wall portions 18, 19. Vessel 11 thus includes vessel wall sections 22, 23 each integrally connected at its ends to the curved side walls 18, 19 of tanks 16, 17.

Upper and lower manifolds 24, 25 as seen in FIG. 1 are used to convey high pressure fluid to and from the heat exchanger 10. The manifolds 24, 25 are shown in FIGS. 1 and 2. An additional outlet manifold 24A can optionally be placed opposite outlet manifold 24. The additional manifold 24A can have a fluid outlet 13A as shown in FIG. 2. In FIG. 1, gusset plates 26, 28 are used to form a structural connection between tank 16 and manifold 24. Gusset plates 27, 29 are used to form a structural connection between tank 16 and manifold 25. The gusset plates 26, 27, 28, 29 are preferably affixed using welding.

Fluid flow through the D tanks is permitted by having fluid inlets and fluid outlets. In the embodiment of FIG. 1, the tank fluid inlet for tank 16 is designated as 30, the fluid outlet is 31. Similarly, tank 17 has a fluid inlet 30 and a fluid outlet 31. This fluid is held at the same pressure as the high pressure fluid flowing through the tanks and manifolds.

The apparatus 10 of the present invention includes a plurality of inner tank elements 32 that convey fluid under low pressure through a plurality of small cylindrically shaped openings 33. The tank wall elements 33 can be hot rolled steel to form beam like load carrying structural elements. Upon assembly, the flat rectangular surfaces 44 abut onto the same flat rectangular surfaces 44 of the adjacent tank 32. The flow through the various openings 33 is via inlet 14 then upwardly from the bottom of heat exchanger 10 to the top thereof in the direction of the arrows 34 in FIG. 1. In FIGS. 2 and 3, the flow of low pressure fluid flow through openings 33 is in a direction out of the page for those figures.

In FIG. 2, a plurality of tanks are shown that are rectangular in horizontal cross-section upon assembly. A slightly different shape tank 32A is shown in FIG. 3. The interiors 20, 21 of the tanks 16, 17 carry high pressure fluid (e.g., water plus steam). The manifolds 24, 25 and 24A are water manifolds that likewise carry high pressure fluid (e.g., water and steam). A process gas flows in the cylindrically shaped openings 33. As shown in FIG. 3, the side walls 22, 23 are connected integrally with the curved walls 18, 19 so that the walls 22, 23 define tension legs.

The present invention provides end tanks 16, 17 that function to carry high pressure fluid while also participating in structural force balancing for the apparatus. High pressure fluid is carried in each interior 20, 21 to help load the tension legs 22, 23 and thus provide an apparatus that functions with a very high pressure differential between fluids.

In FIGS. 2 and 3, the high pressure fluid that flows in interior tanks 32. The wall 35 is a transverse flat wall that is connected to the ends of walls 22, 23 and to the curved wall 18 of the tank 16 as shown in FIG. 3. Thus, the walls 35 in combination with the walls 22, 23 provide contact portions for forming load transfer contact areas. The walls 22, 23 are tensile members while the walls 35 are load carrying beam portions. The combination of walls 22, 23, and 35 hold the tanks 32A together. Another transverse wall 35 extends between and forms a connection to the ends of walls 22, 23 and the curved wall 19 of tank 17. The tanks 32 form high pressure fluid channels 37 as shown in FIG. 3.

Figure 4:
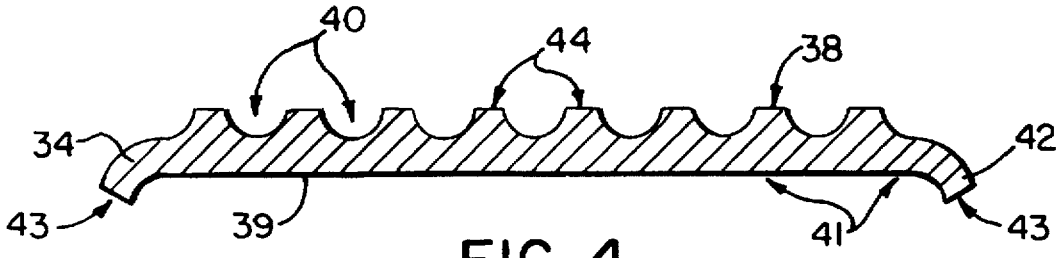
FIG. 4 is a partial sectional view of the preferred embodiment of the apparatus of the present invention.

In FIG. 4, a wall portion of an interior tank 32 is shown, namely the aforementioned tank stock designated as 34. One section 34 is welded to another section 34 in order to construct the individual tank members 32 as shown in the drawings. In the embodiment shown, the wall 34 has sides 38, 39 of different shapes. The side 38 is formed of a plurality of parallel grooves or troughs 40, each generally semicircular in transverse cross section.

Figure 5:
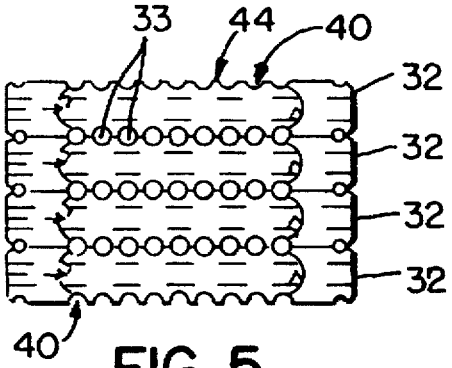
FIG. 5 is a partial top view of the preferred embodiment of the apparatus of the present invention.
Figure 7:
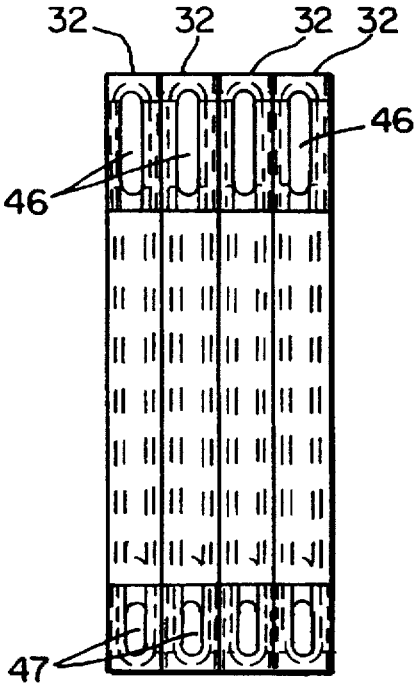
FIG. 7 is a partial elevational view of the modules shown in FIG. 5.
Figure 6:
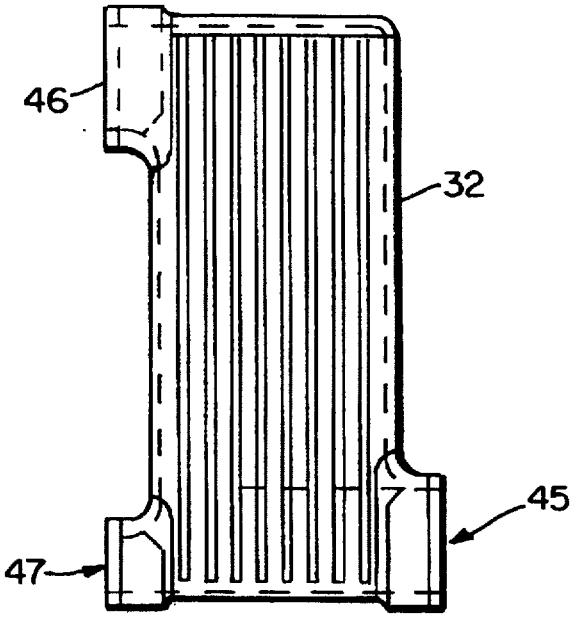
FIG. 6 is a partial elevational view of the end module of FIG. 5.
Figure 8:
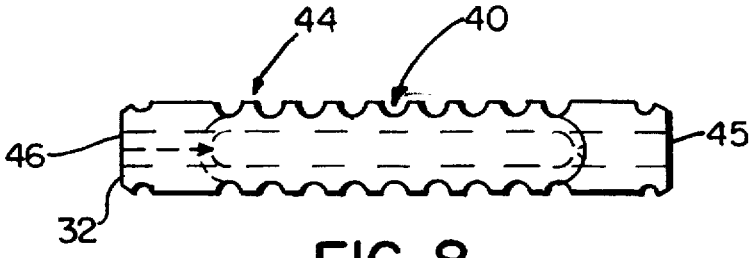
FIG. 8 is a partial top view of the preferred embodiment of the apparatus of the present invention illustrating a single tank.
Figure 10:
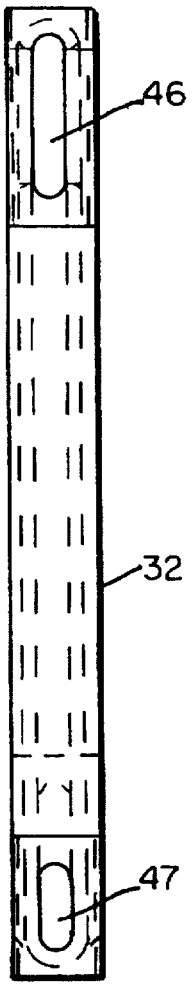
FIG. 10 is an elevational frontal view of the tank of FIG. 8.
Figure 9:
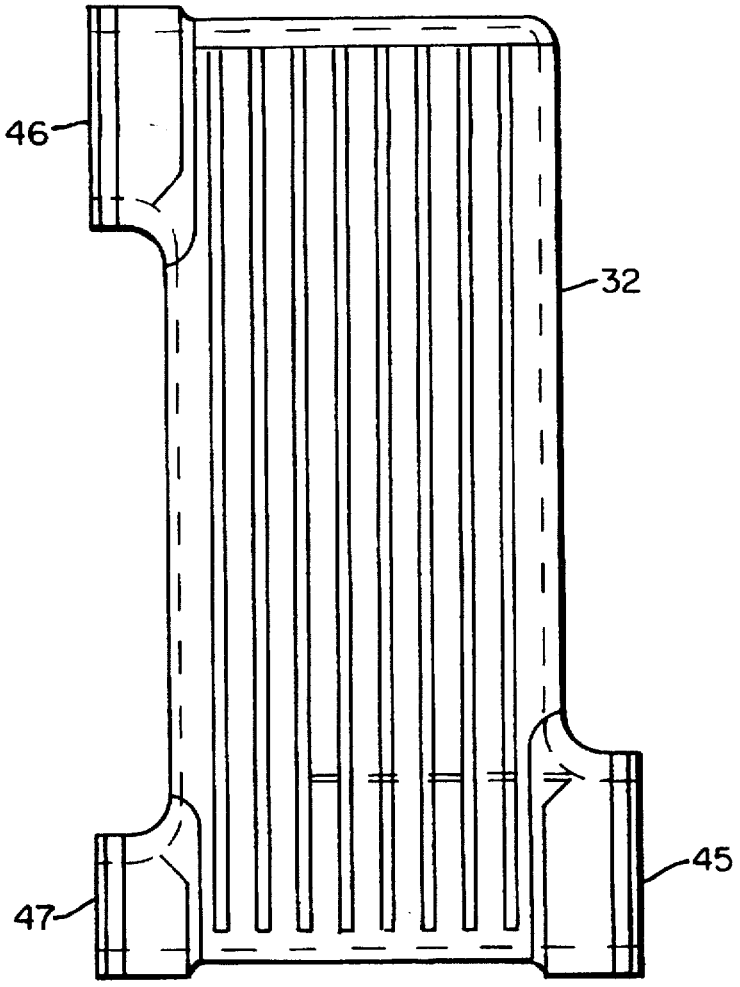
FIG. 9 is an elevational side view of the tank of FIG. 8.
Figure 17A:
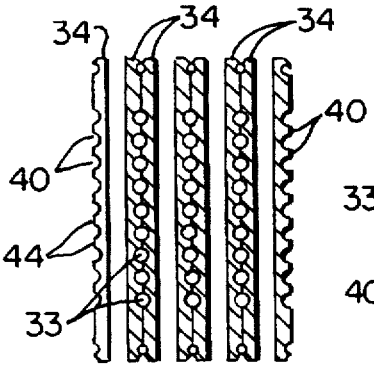
FIG. 17A is a sectional view taken along lines 17A—17A of FIG. 15.
Figure 17B:
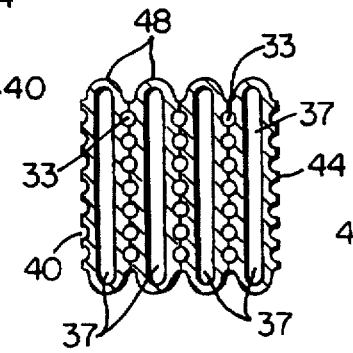
FIG. 17B is a sectional view taken along lines 17B—17B of FIG. 15.

The opposing side 39 is shown as flat along the majority of its length, but may have waves with the same period as the channels on the opposite side. This surface communicates with a pair of curved ends 42, each having a flat surface 43. A recess 41 is formed at surface 43 between ends 42. Upon assembly of two walls 33, the surfaces 42 define a V-shape therebetween that can receive a weld. In FIGS. 17A–17B these welds are indicated as 48. Once welded together, the tanks 32 assume the shape shown in FIGS. 3 and 17B. The troughs 40 are separated by flat rectangular surface areas 44 that abut together when two adjacent tanks are assembled. This configuration is shown in the file assembly of FIG. 3 and in FIG. 5. When the tanks are assembled in the configuration of FIG. 3, the troughs 40 form the circular channels 33. The flat surfaces 44 of adjacent tanks abut up against each other as they are correspondingly sized and shaped. This forms flow channels 37 as two recesses 41 align when two wall sections 34 are welded together. Each tank 32 has an inlet 45 and an outlet 46. An additional opening 47 and manifold 25A can be used as a blowdown outlet for cleaning purposes.

Figure 17C:
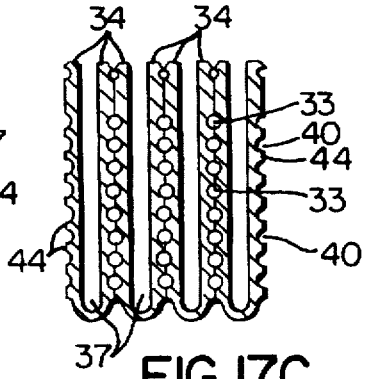
FIG. 17C is a sectional view taken along lines 17C—17C of FIG. 15.
Figure 11:
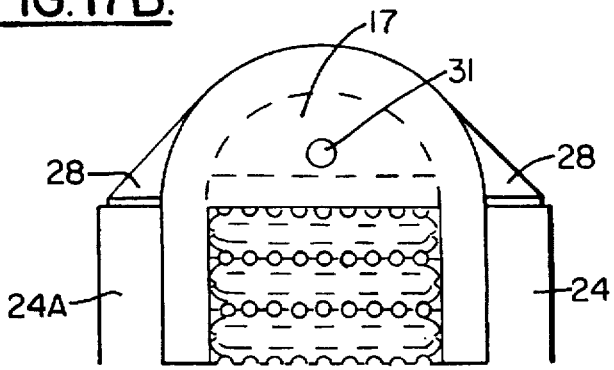
FIG. 11 is a partial plan view of the preferred embodiment of the apparatus of the present invention.
Figure 13:
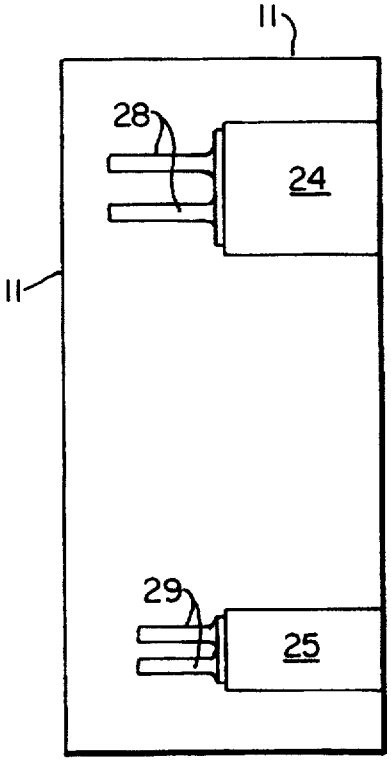
FIG. 13 is a partial elevational view of the preferred embodiment of the apparatus of the present invention.
Figure 12:
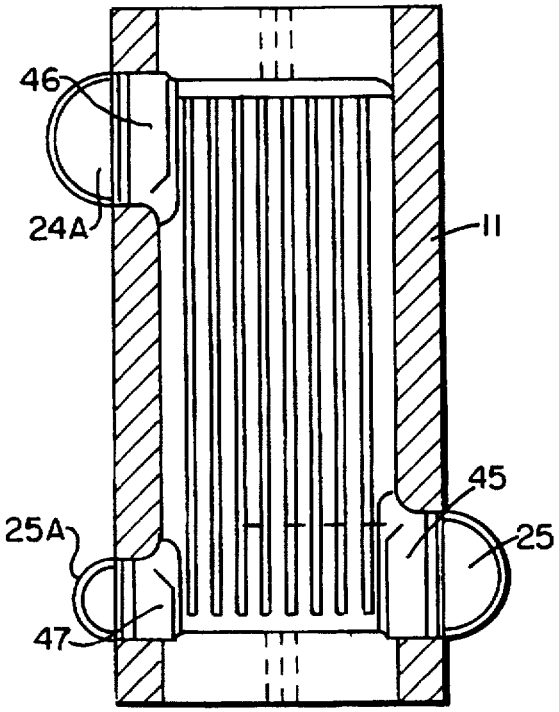
FIG. 12 is a vertical sectional view of the preferred embodiment of the apparatus of the present invention.
Figure 14:
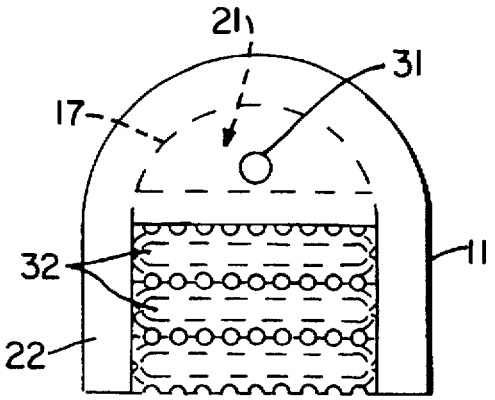
FIG. 14 is a partial top view of the preferred embodiment of the apparatus of the present invention with the manifolds removed.
Figure 16:
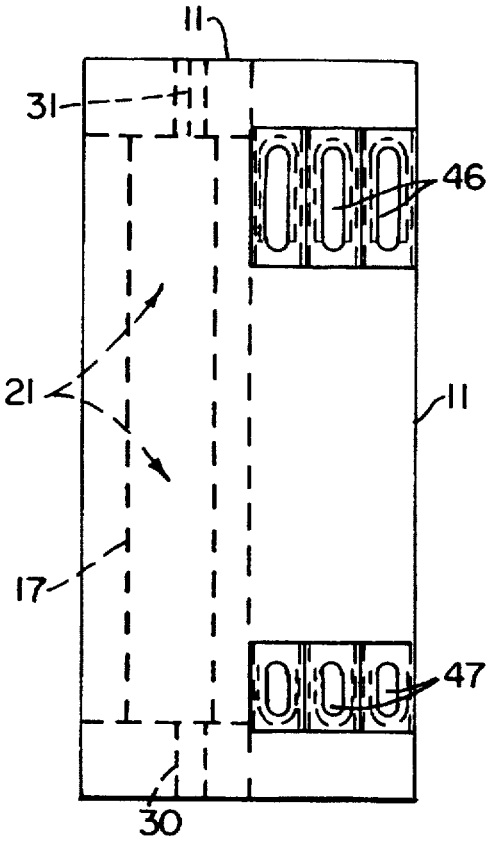
FIG. 16 is another elevational view of the preferred embodiment of the apparatus of the present invention with the manifolds removed.
Figure 15:
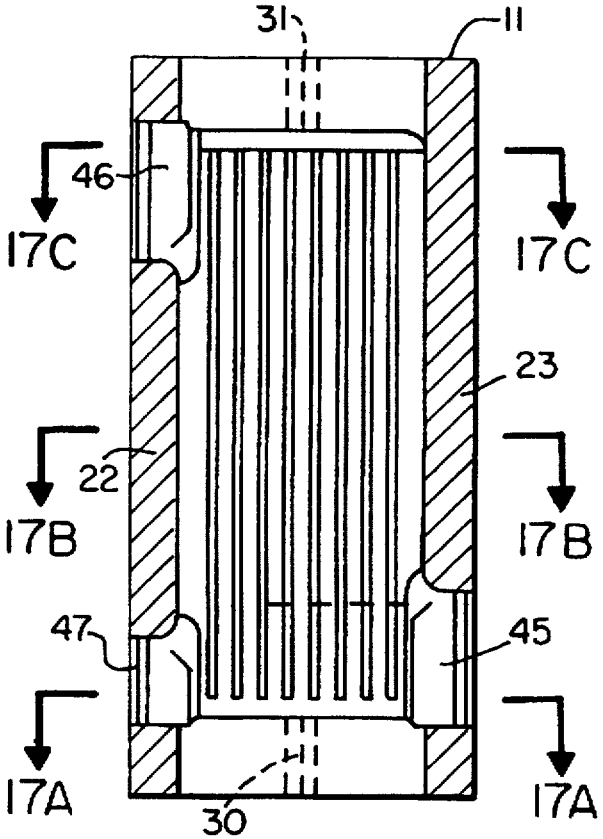
FIG. 15 is a sectional elevational view of the preferred embodiment of the apparatus of the present invention with the manifolds removed.

FIGS. 14–16 shows a fragmentary view of the heat exchanger/boiler 10 of FIGS. 1–3 illustrating more particularly the construction of the individual tanks 32 manifolds, "D" tanks and vessel 11. FIGS. 11–13 show more particularly the construction of the vessel 11 and its manifolds 24, 24A, 25 and 25A as they communicate with the inlets and outlets of a single tank 32. FIGS. 17A–17C show cross-sections of the tank element of FIG. 15 as indicated in FIG. 15.

Figure 18A:
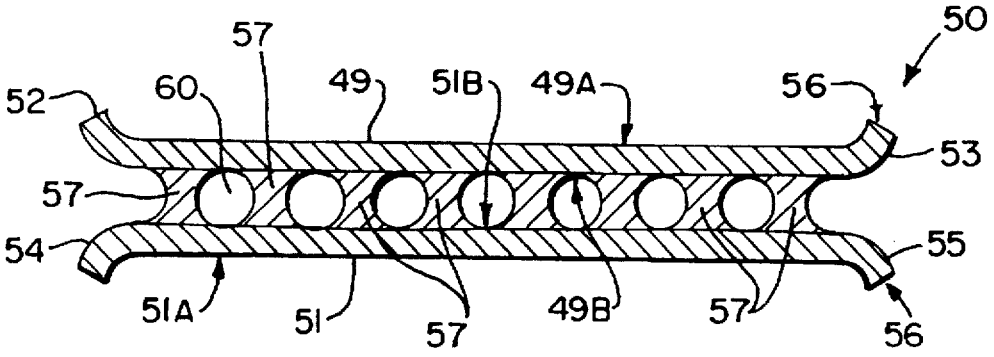
FIGS. 18A–18B are sectional views of an alternate embodiment of the apparatus of the present invention.
Figure 18B:
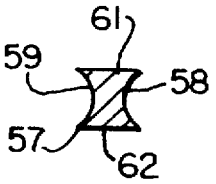

In FIGS. 18A–18B, there can be seen an alternate construction of the embodiment of the present invention showing heat exchanger tank element 50. Tank element 50 is comprised of a pair tank plate stock elements 49, 51. The tank plate 49 has flat opposed surfaces 49A, 49B. The tank plate element 51 has opposed flat surfaces 51A, 51B.

The plate 49 has curved end portions 52, 53. The plate 51 has curved end portions 54, 55 as shown in FIG. 18A. Each of the curved end portions 52, 53, 54, 55 provides a weld surface 52 that forms an acute angle with the surface 49A, 51A.

A plurality of compressive inserts 57 are positioned in between the plates 49, 51 as shown in FIG. 18A. Upon assembly, a conduit 60 is formed in between each pair of compressive inserts 57 as shown in FIG. 18A. The conduit 60 are each elongated and may be generally cylindrical, each being parallel to the other. A compressive insert 57 provides flat surfaces 61, 62 that engage a corresponding flat surface 49B, 51B of the plate stock elements 49, 51 upon assembly as shown in FIG. 18A. In order to form a heat exchanger, tanks such as 50 are arranged side by side so that the curved end portions 54, 55 of one plate 51 abut the curved end portions 52, 53 of the plate 49 of the next tank 50. Weld surfaces 56 of ends 54 55 are positioned at weld surfaces 52, 53. The tanks 50 are then welded together at surfaces 56.

Figure 19A:
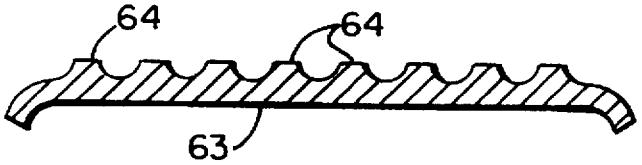
FIGS. 19A–19C are a cross section of the tank plate stock used in the method of the present invention.
Figure 19B:
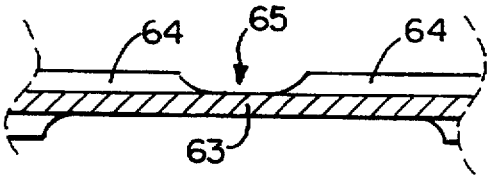
Figure 19C:
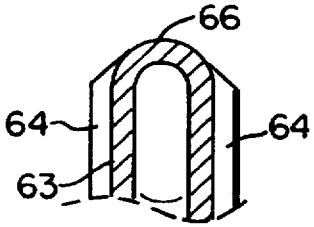

In FIGS. 19A–19C, a method is shown for constructing a single tank element so that it provides a guard against the tendency to develop cracks that often accompany welded areas that are exposed to high heat flux application. The present invention provides an improved method for forming a tank element so that no welds will be exposed to the low pressure fluid until after it has been through a majority of the exchanger and so it is closer to the main temperature of the exchanger than it is at the inlet.

In FIGS. 19A–19C, a tank element 63 is bent to the shape shown in FIG. 19C. Prior to bending, a notch 65 is cut so that a central portion of each longitudinally extending projecting portions 64 is removed. FIG. 19B is a section taken at ninety degrees (90°) with respect to FIG. 19A. The element 63 is then bent approximately in half (e.g. over a mandrel) so that the region of the plate near the bend 66 looks U-shaped, similar to that in FIG. 19C. After bending the plate element 63 to the configuration shown in FIG. 19C, it may be desirable to pre-heat the plate element 63 in the region of the bend 66 to prevent excess strain hardening, or cracking.

This shape of FIG. 19C then forms the majority of the tank element and is now ready to have its opposing seams welded. Such a welded portion will be on the sides and the top and high fluid pressure fluid inlets and outlets. Alternatively, the plate could be bent in the form of a "J" and welded along the bottom. This would provide a weld exposed to the low pressure fluid inlet. However, it would not be at the point of maximum heat flux which is there immediately around the low pressure fluid channel inlets.

FIG. 19A is thus a depiction of the cross-section of the tank plate stock 63 used in the present invention. In FIG. 19B, there is a depiction of cross-section of the plate stock 63 shown in FIG. 19A taken at ninety degrees (90°) with respect to FIG. 19A. FIG. 19B indicates how the tank plate stock 63 will be notched to allow bending. In FIG. 19C, the bending has taken place about a mandrel.

The following table lists the parts numbers and parts descriptions as used herein and in the drawings attached hereto.

PARTS LIST

| Part Number | Description |
|---|---|
| 10 | heat exchanger |
| 11 | vessel body |
| 12 | high pressure inlet |
| 13 | high pressure outlet |
| 14 | low pressure inlet |
| 15 | low pressure outlet |
| 16 | D tank |
| 17 | D tank |
| 18 | tank wall |
| 19 | tank wall |
| 20 | interior |
| 21 | interior |
| 22 | vessel wall section |
| 23 | vessel wall section |
| 24 | manifold |
| 24A | manifold |
| 25 | manifold |
| 25A | manifold |
| 26 | gusset plate |
| 27 | gusset plate |
| 28 | gusset plate |
| 29 | gusset plate |
| 30 | D tank fluid inlet |
| 31 | D tank fluid outlet |
| 32 | inner tank element |
| 33 | interior tank wall |
| 34 | transverse wall |
| 35 | transverse wall |
| 36 | open space |
| 37 | channel |
| 38 | side of wall |
| 39 | side of wall |
| 40 | groove |

-continued

PARTS LIST

| Part Number | Description |
|---|---|
| 41 | recess |
| 42 | weld surface |
| 43 | flat surface |
| 44 | flat surface |
| 45 | inlet |
| 46 | outlet |
| 47 | opening |
| 48 | weld |
| 49 | tank plate stock |
| 49A | flat surface |
| 49B | flat surface |
| 50 | heat exchanger tank element |
| 51 | tank plate stock |
| 51A | flat surface |
| 51B | flat surface |
| 52 | curved end portion |
| 53 | curved end portion |
| 54 | curved end portion |
| 55 | curved end portion |
| 56 | weld surface |
| 57 | compressive insert |
| 58 | concavity |
| 59 | concavity |
| 60 | conduit |
| 61 | flat surface |
| 62 | flat surface |
| 63 | tank stock element |
| 64 | projection |
| 65 | notch |
| 66 | bend |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A heat exchanger comprising:

a) a plurality of tanks assembled together, each of said tanks comprising a separate structural member;

b) a pair of opposed generally parallel surfaces on each tank, the surfaces of adjacent tanks being in face-to-face contact;

c) a plurality of generally parallel grooves formed on one of the opposed surfaces of each tank, the grooves being correspondingly placed on each tank so that a closed fluid conveying channel is formed when two tanks are assembled together and oriented so that the grooves of the tanks are aligned;

d) contact portions for forming load transfer contact areas between adjacent tanks when two tanks are assembled, said contact areas extending substantially the length of the adjacent groove;

e) a load carrying portion that extends between the opposed surfaces and to the periphery of each tank; and f) a second plurality of fluid conveying channels extending through the load carrying portion of each tank;

g) a fluid inlet for adding a first fluid flow at a lower pressure value to the first plurality of channels;

h) a fluid outlet for removing the first fluid flow from the first plurality of channels;

i) a fluid inlet for adding a second fluid to the second plurality of channels at a higher pressure value;

j) a fluid outlet for removing the second fluid flow from the second plurality of channels;

k) wherein the first and second fluid flow are maintained as separate fluid flow streams and at substantial pressure differential during use; and l) a heat exchanger vessel having a restraining structure for holding the tanks together.

2. The heat exchanger apparatus of claim 1 wherein the pressure differential is between about 900–3200 p.s.i. using ordinary strength carbon steel having a nominal yield strength of about 36,000 psi.

3. The heat exchanger apparatus of claim 1 wherein the tanks are variable thickness metallic elements.

4. The heat exchanger apparatus of claim 3 wherein the tanks are each comprised of a tank body of hot rolled steel.

5. The heat exchanger apparatus of claim 1 wherein the first set of channels are low pressure channels and the second plurality of channels are high pressure channels.

6. The heat exchanger apparatus of claim 1 wherein the restraining structure comprises in part a pair of restraining structure members placed at opposite end portions of the assembled plurality of tanks at least one of said members being a tank.

7. The heat exchanger apparatus of claim 6 wherein the restraining structure members are "D" shaped tanks placed respectively on each end of the assembled plurality of tanks, and further comprising tension members connecting the two "D" shaped tanks together.

8. The heat exchanger apparatus of claim 1 wherein the grooves are U-shaped in transverse cross section.

9. The heat exchanger apparatus of claim 1 wherein one of the opposed surfaces is flat.

10. The heat exchanger apparatus of claim 1 wherein one of the opposed surfaces is a wavy surface with crest portions spaced apart with the same spacing as the spacing of the grooves.

11. The heat exchanger of claim 1 wherein the grooves are parallel.

12. The heat exchanger of claim 11 where in the grooves have flat surfaces therebetween.

13. A heat exchanger comprising:

a) a plurality of tanks assembled together, each of said tanks comprising a separate metallic hot-rolled structural, load carrying member;

b) a pair of opposed parallel surfaces on each tank, the surfaces of adjacent tanks carrying the grooves being in face-to-face contact;

c) upon assembly one of said surfaces being generally flat and the other surface having a plurality of grooves with flat surfaces between the grooves the grooves being correspondingly placed on each tank so that a closed fluid conveying conduit is formed when two tanks are assembled together and oriented so that the grooves of the tanks are aligned;

d) a load carrying beam portion that extends between the opposed surfaces and to the periphery of each tank, said load carrying portion having a thickness that is at least about the depth of each groove;

e) a fluid conveying flow channel extending through the load carrying beam portion of each tank, generally opposite said grooves;

f) a fluid inlet for adding a first fluid flow at a first lower pressure value to the plurality of conduits;

g) a fluid outlet for removing the first fluid flow from the plurality of conduits;

h) a fluid inlet for adding a second fluid flow to the fluid flow channel;

i) a fluid outlet for removing the second fluid from the fluid flow of channel;

j) wherein the first and second fluids flows are maintained at substantial pressure differential during use;

k) a restraining structure for holding the tanks together.

14. The heat exchanger of claim 13 wherein the grooves form conduits when two tanks are assembled that are parallel enabling flow through the conduits in the same direction.

15. The heat exchanger of claim 14 wherein the enabled flow through the conduits will have no pressure loss due to fluid turns or bends.

16. The heat exchanger of claim 1 wherein each tank is comprised of flat plates with regularly spaced compressive inserts positioned in between the plates.

17. The heat exchanger of claim 1 wherein the tanks are formed from plates that are bent into a generally "U" shape with a finite inner radius so that the low pressure flow inlet of the heat will expose no welds to incoming hot fluid streams.

18. The heat exchanger of claim 1 wherein the tanks are formed into a "J" shape with a finite inner radius so that a low pressure fluid inlet is provided in which a welded portion is not directly adjacent the point of elevated or maximum heat flux in the tank material.

19. The heat exchanger apparatus of claim 1 wherein the tank walls which mate with and are supported by the walls of adjacent tanks when viewed in cross-section cut perpendicular to the direction of low pressure flow display a periodic variable material thickness.

20. The heat exchanger apparatus of claim 19 wherein the wall thickness variations are within a ratio equal to or greater than 1.25 to 1.

21. The heat exchanger apparatus of claim 1 wherein a relatively large proportion of each tank side wall is in direct contact with the tank wall of the adjacent tank.

22. The heat exchanger of claim 21 wherein the ratio of contact area to the total tank side wall area is greater than or equal to 1 to 10.

* * * * *